US005984740A

United States Patent [19]

Ikeda et al.

[11] Patent Number: 5,984,740

[45] Date of Patent: Nov. 16, 1999

[54] WATERCRAFT PROPULSION SYSTEM

[75] Inventors: Kenji Ikeda; Masayoshi Nanami, both of Shizuoka, Japan

[73] Assignee: Yamaha Hatsudoki Kabushiki Kaisha, Japan

[21] Appl. No.: 08/953,301

[22] Filed: Oct. 17, 1997

[30] Foreign Application Priority Data

Oct. 17, 1996 [JP] Japan ..... 8-297493

[51] Int. Cl.[6] ..... B63H 11/02

[52] U.S. Cl. ..... 440/38; 440/75

[58] Field of Search ..... 440/38, 40–43, 440/75; 114/270, 55.5, 55.7; 60/221

[56] References Cited

U.S. PATENT DOCUMENTS

| | | | |
|---|---|---|---|
| 2,406,290 | 8/1946 | Hait | 114/270 |
| 3,306,046 | 2/1967 | Trapp | 440/41 |
| 3,350,958 | 11/1967 | Casale | 440/75 |
| 3,420,204 | 1/1969 | Samuel | 440/41 |
| 3,601,989 | 8/1971 | Austin et al. | 440/41 |
| 3,906,886 | 9/1975 | Elger | 440/38 |
| 3,943,876 | 3/1976 | Kiekhaefer | 440/43 |
| 3,948,206 | 4/1976 | Tyler | 440/38 |
| 5,261,841 | 11/1993 | Imaeda | 114/270 |
| 5,438,946 | 8/1995 | Kobayashi . | |
| 5,511,505 | 4/1996 | Kobayashi et al. . | |

*Primary Examiner*—Sherman Basinger

*Attorney, Agent, or Firm*—Knobbe, Martens, Olson & Bear, LLP

[57] ABSTRACT

A propulsion system for a watercraft includes an upwardly inclined drive shaft to improve acceleration. The upwardly inclined orientation of the impeller shaft, and thus a similar orientation of the discharge stream exiting the jet propulsion system, causes the bow of the watercraft to ride out of the water when the watercraft is planing. The watercraft thus has less surface contact with the water, and travels faster.

21 Claims, 5 Drawing Sheets

WATERCRAFT PROPULSION SYSTEM

BACKGROUND OF THE INVENTION

1. Field of the Invention

The present invention relates in general to a watercraft, and in particular to a propulsion system for a watercraft.

2. Description of Related Art

Personal watercraft have become popular in recent years. Jet propulsion units commonly power these type of watercraft and include a motor driven impeller. The impeller operates within a water duct of the jet propulsion unit. The impeller draws in water through a water intake opening on the underside of the watercraft's hull and into the intake duct. The impeller thence compresses the water and forces it through a stationary discharge nozzle to form a jet of water. This water jet propels the watercraft.

A steering nozzle mates with the discharge end of the discharge nozzle and redirects the water jet stream for steering movement of the watercraft. For this purpose, the steering nozzle commonly rotates about at least a vertical axis and is controlled by a handlebar assembly of the watercraft.

Prior watercraft designs have attempted to minimize the vertical distance between the impeller and the water inlet opening in order to improve the performance of the jet propulsion unit. Pump inefficiencies can result when a substantial portion of the impeller's work goes to drawing water up into the water duct, as opposed to using more of that energy to increase the pressure of the water flowing into the discharge nozzle. The vertical rise of the intake duct therefore has generally been kept small by placing the impeller close to the hull underside. In this position, an impeller shaft, which drives the impeller, often slopes downward in a fore-to-aft direction. The resulting water stream exiting the discharge nozzle projects downward into the body of water in which the watercraft is operated.

SUMMARY OF THE INVENTION

The present invention includes the recognition that the downward sloped orientation of prior propulsion systems produces a trust loading on the watercraft that forces the bow of the watercraft against the water. The watercraft thus planes on a larger surface area of the hull than is optimal for achieving the fastest possible top-end speed of the watercraft.

One aspect of the present invention thus involves a watercraft with an improved propulsion system to enhance the watercraft's top speed. The watercraft comprises a hull carrying a propulsion system. The propulsion system includes at least one jet propulsion unit which is located on an underside of the hull. The jet propulsion unit has an immovable discharge nozzle which is configured to expel a stream of water along a fixed discharge axis of the jet propulsion unit. The jet propulsion unit is arranged on the hull so as to orient the discharge axis of the jet propulsion unit in an upwardly inclined direction relative to a surface of a body of water in which the watercraft is operated. The resulting upward stream of water produces a downward thrust loading on the stem of the watercraft which causes a bow of the watercraft hull to rise out of the water. As a consequence, less surface area of the hull contacts the water when the watercraft rides up on plane, thereby reducing drag on the watercraft hull and increasing the top speed of the watercraft.

Another aspect of the present invention involves a watercraft comprising a hull and a propulsion unit. The hull includes a keel having a generally horizontally extending portion that is located near an aft end of the watercraft. The propulsion system includes an engine and a propulsion unit. The engine has an output shaft that is coupled to a drive shaft of the propulsion unit in order to drive the same. The engine is located within the watercraft hull and the propulsion unit is carried on the hull's underside. The propulsion unit is arranged thereon so as to position the drive shaft in an upwardly inclined orientation in a fore-to-aft direction relative to the generally horizontally extending portion of the hull's keel.

Further aspects, features, and advantages of the present invention will become apparent from the detailed description of the preferred embodiment which follows.

BRIEF DESCRIPTION OF THE DRAWINGS

The above-mentioned and other features of the invention will now be described with reference to the drawings of preferred embodiments of the present watercraft. The illustrated embodiments are intended to illustrate, but not to limit the invention. The drawings contain the following figures.

DETAILED DESCRIPTION OF PREFERRED EMBODIMENTS OF THE INVENTION

The present propulsion system has particular utility for use with personal watercraft, and thus, the following describes the propulsion system in the context of a personal watercraft. This environment of use, however, is merely exemplary. The present propulsion system can be readily adapted by those skilled in the art for use with other types of watercraft a well, such as, for example, but without limitation, small jet boats and the like.

Figure 1:
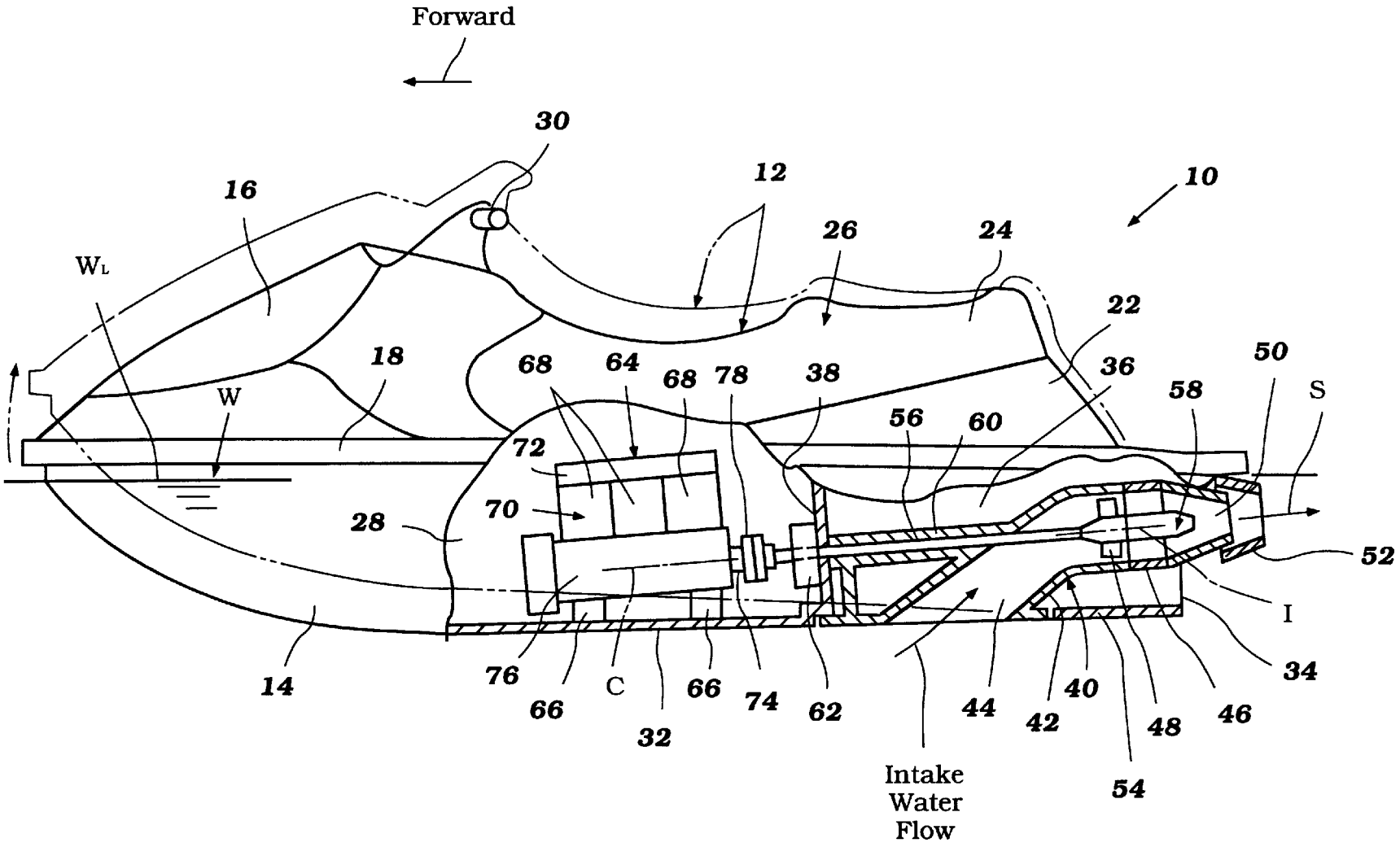
FIG. 1 is a side elevational view of the small watercraft configured in accordance with preferred embodiment of the present invention, with a portion broken away and shown in section in order to depict several of the internal components of the watercraft.
Figure 2:
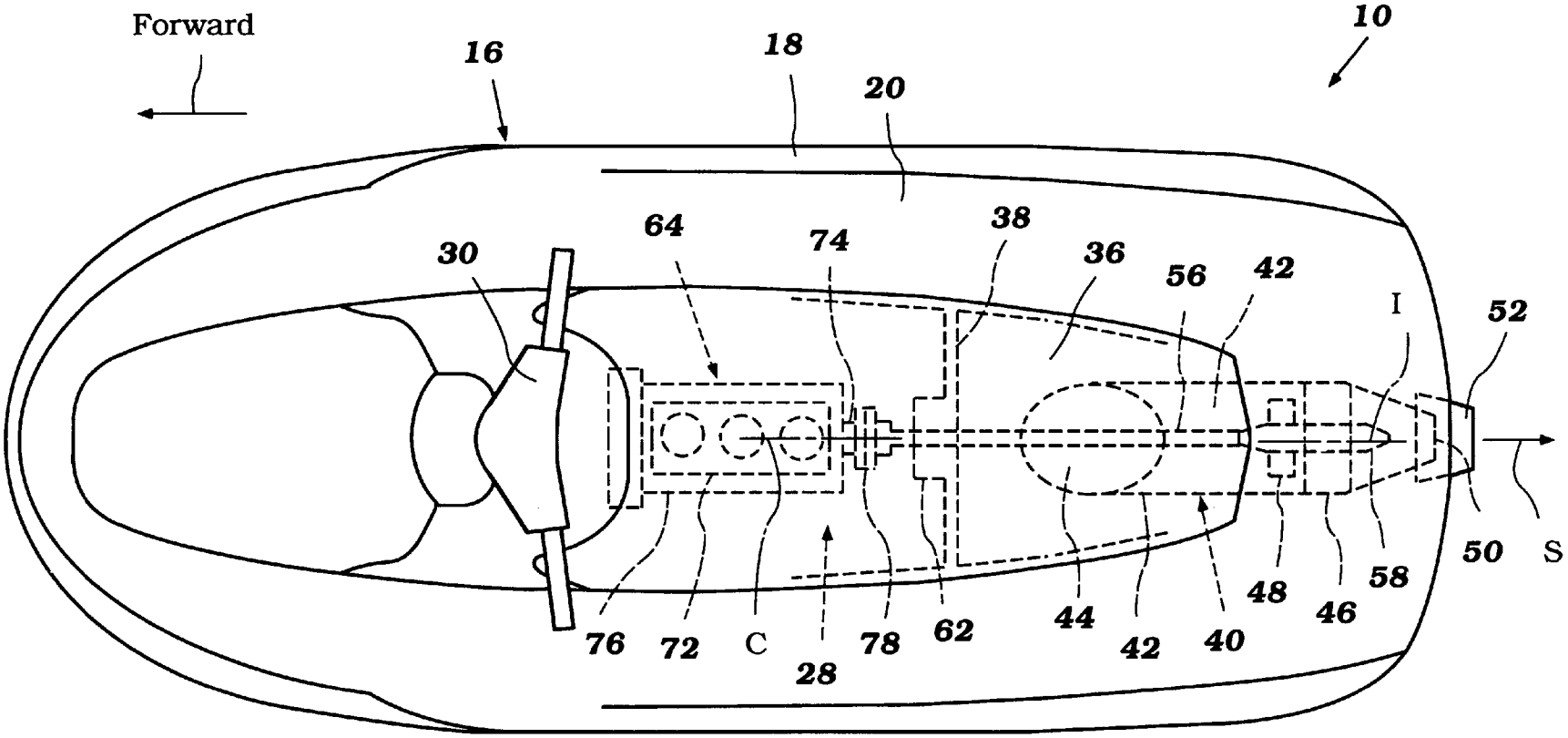
FIG. 2 is a top plan view of the watercraft of FIG. 1 and illustrates several internal components in phantom.

With initial reference to FIGS. 1 and 2, the watercraft 10 includes a hull 12 that is formed by a lower hull section 14 and an upper deck section 16. The hull sections 14, 16 are formed of a suitable material such as, for example, a molded fiberglass reinforced resin, and can be made by any of a wide variety of methods. For instance, the deck 16 and the hull 14 can each be formed using a sheet molding compound (SMC), i.e., a mixed mass of reinforced fiber and thermal setting resin, that is processed in a pressurized, closed mold. The lower hull section 14 and the upper deck section 16 are fixed together around their peripheral edges in any suitable manner. For instance, the peripheral flanges of the upper deck section 16 and the lower hull section 14 can nest together and be bonded.

The upper deck section 16 and the lower hull portion 14 together define a pair of raised gunnels 18 positioned on opposite sides of the aft end of the upper deck assembly 16.

The raised gunnels define a pair of foot areas (FIG. 2) that generally extend longitudinally and parallel to the sides of the watercraft 10. In this position, the operator and any passenger sitting on the watercraft 10 can place their feet in the foot areas 20 with the raised gunnels 18 shielding the feet and lower legs of the riders. A non-stick (e.g., rubber) mat desirably covers the foot areas 20 to provide increased grip and traction for the operator and the passengers.

Toward the aft end of the watercraft 10, a seat pedestal 22 rises above the foot areas 20. The pedestal 22 supports a seat cushion 24 to form a seat assembly 26. In the illustrated embodiment, the seat assembly 26 has a longitudinally extending, straddle-type shape which may be straddled by an operator and by at least one or two passengers. For this purpose, the raised pedestal 22 has an elongated shape and extends longitudinally generally along a center line of the watercraft 10. The seat cushion 24 is removably attached to the pedestal 22 by a quick-release latching assembly, as known in the art. An access opening (not shown) is formed (at least in part) beneath the seat cushion 24 to provide access into an engine compartment 28 formed within the hull 12.

A control mast is formed just forward of the seat assembly 26. The control mast includes a steering column that supports a steering operator 30. In an illustrated embodiment, the steering operator 30 is a handlebar assembly; however, other steering operators, such as, for example, a steering wheel or a control stick (i.e., joystick), also can be used. The steering column operates a steering actuator (not shown). The actuator affects steering movement of the watercraft 10 in the manner described below.

As also seen in FIG. 1, the lower hull is designed such that the watercraft 10 planes or rides on a minimum surface area at the aft end of the hull when up on plane in order to optimize the speed and handling of the watercraft 10. For this purpose, in the illustrated embodiment, the lower hull section 14 generally has a V-shape which includes a generally straight horizontally extending keel 32. Incline sections (not shown) extend between the keel and the sides of the watercraft, which form a portion of the raised gunnels 18. These incline sections can be configured to include one or more chines and/or one or more stakes, and can be formed by a plurality of sections of differing dead rise angles.

Towards a transom 34 of the watercraft 10, the lower hull section 14 includes an outwardly extending recessed channel or tunnel 36. The tunnel 36 has a generally parallelpiped shape and opens through the rear of the transom 34, as understood from FIG. 1. The tunnel 36 terminates at its front end in a front wall. In an illustrated embodiment, the front wall forms a portion of a bulkhead 38 within the hull 12. The bulkhead 38 separates the tunnel 36 from the engine compartment 28.

A jet propulsion unit 40 propels the watercraft 10. The jet propulsion unit 40 is mounted within the tunnel 36 by a plurality of bolts. An intake duct 42 of the jet propulsion unit 40 defines an inlet opening 44 on the underside of the lower hull section 14. The inlet duct 42 leads to an impeller housing 46 in which an impeller 48 of the jet pump 40 operates. The impeller housing 46 also acts as a pressurization chamber and delivers the water flow from the impeller to a discharge nozzle 50.

A steering nozzle 52 is supported at the downstream end of the discharge nozzle 50 by a pair of vertically extending pivot pins. In the exemplary embodiment, the steering nozzle 52 includes a lever on one side which is moved by the actuator (e.g., a bowden-wire cable) that is controlled by the steering operator 30. In this manner, steering movement is effected by movement of the operator 30. A propulsion stream of water exists the steering nozzle to propel the watercraft. A direction of discharge S of the water jet stream desirably corresponds to a central axis of the discharge nozzle 50.

A ride plate 54 covers a portion of the tunnel 36 behind the inlet opening 44 to enclose the impeller chamber and nozzle assembly within the tunnel 36. In this manner, the lower opening of the tunnel 36 is closed to provide in part a planar surface for the watercraft 10. The ride plate 54 desirably includes a generally straight, horizontally extending central section which is at least parallel to the keel 32 of the hull lower section 14.

An impeller shaft 56 drives the impeller 48. The aft end of the impeller shaft 56 is supported within the impeller housing 46 by a bearing assembly 58. The bearing assembly suitably journals the impeller shaft 56 for rotation about its axis I. The axis I preferably aligns with the central axis of the discharge nozzle 50 (and thus the direction of discharge S of the water jet stream).

The impeller shaft 56 extends forward of the jet propulsion unit 40 through a cylindrical casing 60 that is integrally formed with the inlet duct 42. The impeller shaft 56 extends through the bulkhead 38 and is desirably supported thereon by a rubber bearing/seal assembly 62. The assembly 62 includes grease-backed seals to inhibit water from the intake duct 42 from entering the engine compartment 28.

As best seen in FIG. 1, the aft bearing assembly 58 is located farther above the keel of the watercraft 10 than is the front bearing assembly 62. As a result, the impeller shaft 56 is skewed relative to the keel 32. The impeller shaft 56 is inclined upwardly as it extends from its forward end toward its aft end. The bulkhead 38, in order to compensate for the skew orientation of the impeller shaft 56, slopes forward as it extends upward. The degree of forward slope of the bulkhead 38 desirably matches the angle by which the impeller shaft is skewed from the keel 32.

The lower hull portion 14 principally defines the engine compartment 36 forward of the bulkhead 38. Except for a conventional ventilation system, which includes a plurality of air ducts, the engine compartment 38 is normally sealed so as to enclose an engine 64 and a fuel system of the watercraft 10 from the body of water W in which the watercraft 10 is operated.

The internal combustion engine 64 drives the impeller shaft 56 to power the jet propulsion unit 40. The engine 64 is positioned within the engine compartment 28 and is mounted centrally within the hull 12. Vibration-absorbing engine mounts 66 secure the engine 64 to the lower hull section 14.

In the illustrated embodiment, the engine 64 includes three in-line cylinders 68. The engine 64 is positioned such that the row of cylinder 68 lies parallel to a longitudinal axis of the watercraft, running bow to stern, as best seen in FIG. 2. The engine can operate on either a two or four stroke principal. Those skilled in the art, however, will really appreciate that the present propulsion system can include any of a variety of engine types having other numbers of cylinders, having other cylinder arrangements, and operating on other combustion principals.

A cylinder block 70 and a cylinder head assembly 72 desirably form the cylinder 68 of the engine 64. A piston (not shown) reciprocates in each cylinder 68. The pistons together drive a crankshaft 74, in a known manner. The crankshaft 74 is desirably journaled within a crankcase 76, which in the illustrated embodiment, is formed between a crankcase member and lower end of the cylinder block 70. A connecting rod links the corresponding piston to the crankshaft 74. The corresponding cylinder bore, piston and cylinder head of each cylinder 68 form a variable-volume chamber, which at minimum volume defines a combustion chamber.

Each combustion chamber communicates with a charge former of an induction system (not shown). The induction system receives air through a throttle device and fuel from a fuel supply system. The induction system produces a fuel charge which is delivered to the cylinder 68 in a known manner.

In the illustrated embodiment, the crankshaft 74 constitutes an output shaft of the engine 64 and directly drives the impeller shaft 56; however, the engine 64 can include a drive mechanism that interconnects the crankshaft to an output shaft of the engine 64. Such a drive mechanism in some applications can reduce the rotational speed (i.e., step down the speed) of the output shaft relative to the crankshaft.

In the illustrated embodiment, the crankshaft 74 rotates about an axis C. The rotational axis C of the crankshaft 74 desirably aligns with the rotational axis I of the impeller shaft. For this purpose, the engine mounts 66 support the engine in a non-level orientation. That is, the engine mount 66 support the aft end of the engine 64 above the forward end of the engine 64. The crankshaft 74 therefore is skewed relative to the keel 32 by the same angle by which the impeller shaft is skewed.

A coupling 78 in the present embodiment interconnects the engine crankshaft 74 to the impeller shaft 56. The coupling 78 desirably is positioned near the aft end of the engine 64 just forward of the support bearing 62 on the bulkhead 38. The coupling directly transfer rotational movement of the crankshaft 74 to the impeller shaft 56, such that the shafts 74, 56 rotate together.

The resulting upwardly oriented configuration of the propulsion unit 40 causes the bow of the watercraft to ride out of the water when the watercraft 10 travels up on plane. The watercraft 10 consequently planes on a lessen surface area to increase the top speed of the watercraft. The optimal angle of incident between the keel 32 in the direction of discharge S (i.e., the rotational axis of the impeller shaft 36) can be determined empirically. Every hull design will behave differently. Too small of an angle though will fail to optimize the top speed of the watercraft, while too large of an angle can cause the watercraft to purpose when up on plane.

Figure 3:
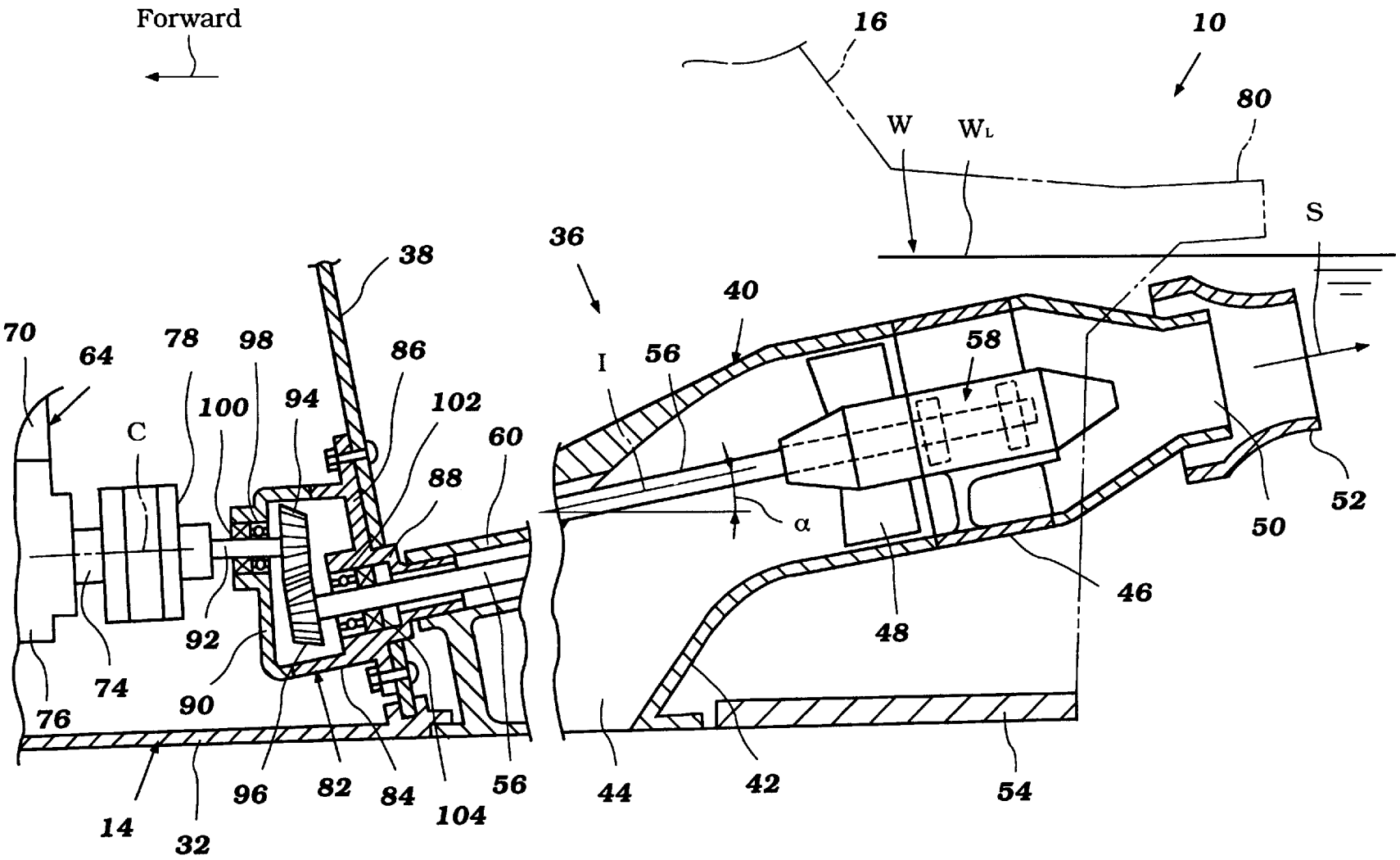
FIG. 3 is an enlarged sectional side view of a propulsion system configured in accordance with another preferred embodiment of the present invention.
Figure 4:
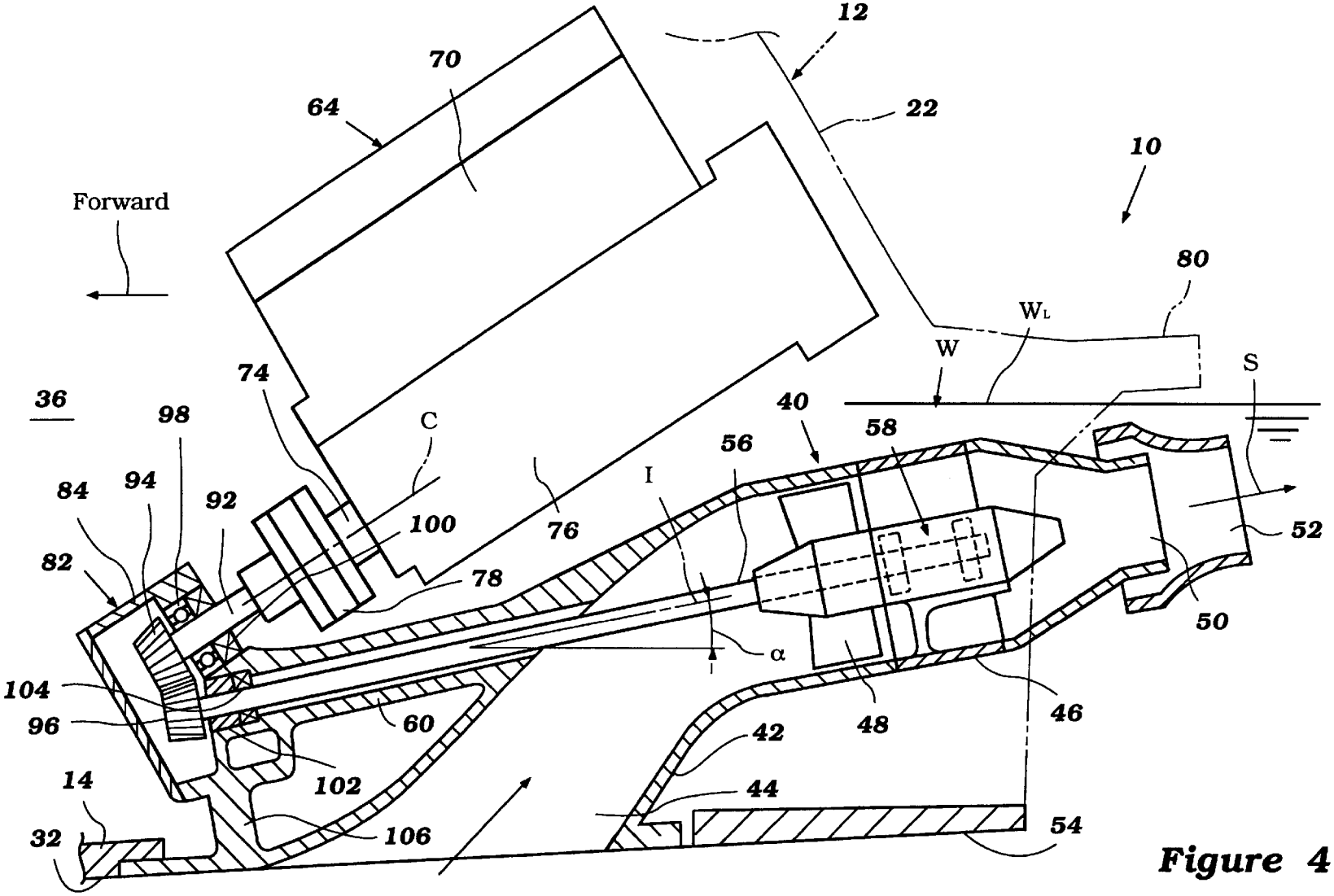
FIG. 4 is an enlarged sectional side view of a propulsion system configured in accordance with an additional preferred embodiment of the present invention.
Figure 5:
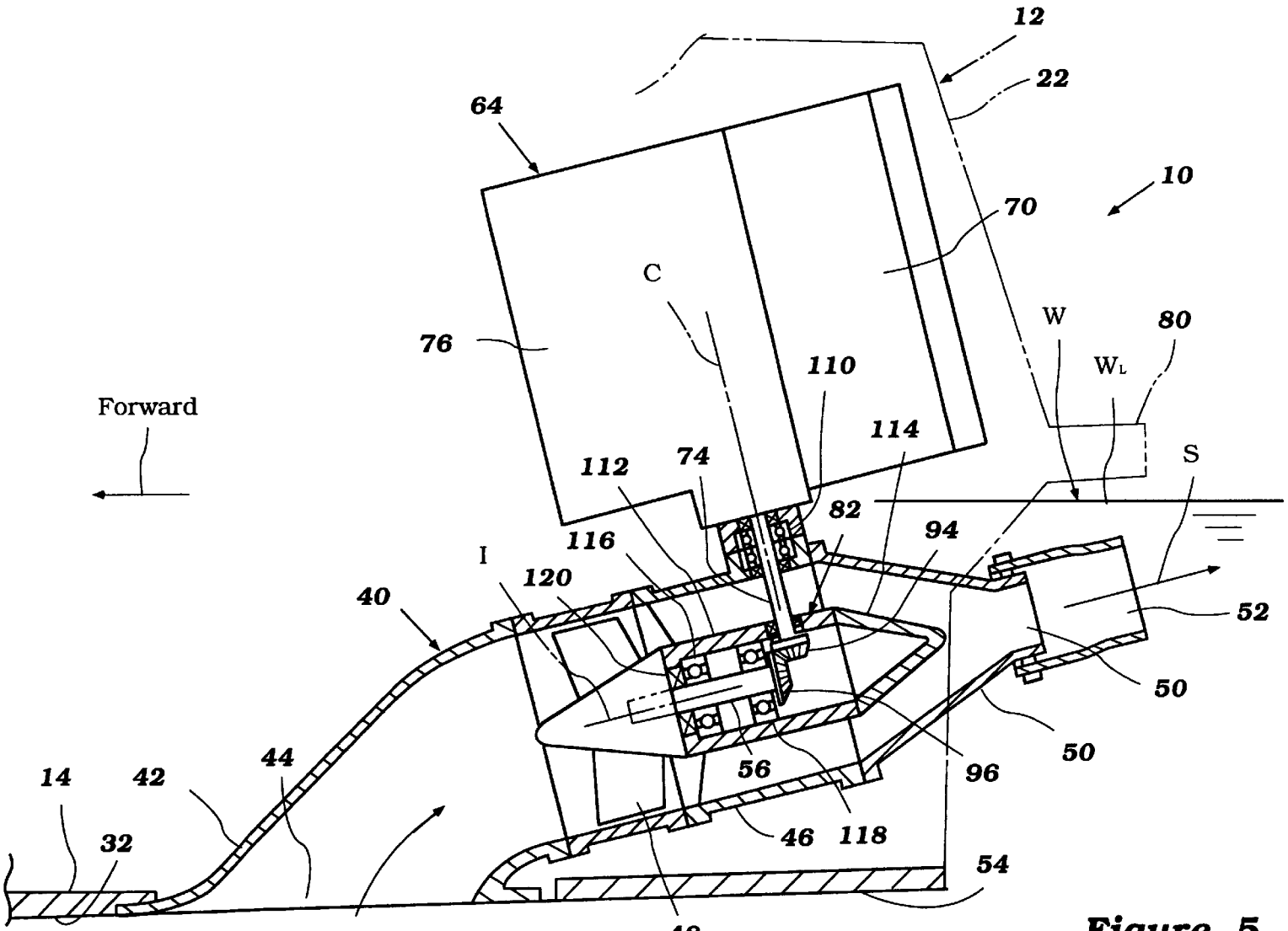
FIG. 5 is an enlarged sectional side view of a propulsion system configured in accordance with another preferred embodiment of the present invention.

FIGS. 3, 4 and 5 illustrate three additional embodiments of the present invention in which the discharge direction S of the water stream exiting the propulsion unit is inclined upward, similar to the propulsion system described above. In each of these embodiments, however, a transmission is employed between the engine and the impeller shaft, instead of the direct drive arrangement described in connection with the embodiment illustrated in FIGS. 1 and 2 above. The general components of the jet propulsion, the engine, and the watercraft hull, however, are generally similar between all the embodiments. Accordingly, like reference numerals have been used for similar components between the embodiments, and it should be understood that the foregoing description of such similar components should apply equally to the following embodiment, unless otherwise indicated.

With reference to FIG. 3, the jet propulsion unit 40 is positioned within the tunnel 36 of the aft end of the watercraft 10. A rear deck 80 extends above the discharge nozzle 50 of the jet propulsion unit 40.

The impeller shaft 56 is skewed by an angle a relative to the keel 32 of the hull 14. The discharge nozzle 50 is concentrically positioned about the rotational axis I of the impeller shaft 56. Thus, the stream of water S exiting the discharge nozzle 50 of the jet propulsion unit 40 has an upwardly incline orientation relative to the water level WL when the watercraft rides up on plane. As a result, the bow with the watercraft 10 rides out of the water to increase the watercraft's top speed, as described above.

The engine 64 drives the impeller shaft 56 through a transmission 82. In this embodiment, the engine 64 is arranged within the engine compartment 28 to orient the rotational axis C of the crankshaft 74 in a generally parallel orientation relative to the keel 32 of the hull; at least that portion of the keel proximate to the engine and aft end of the watercraft 10.

The transmission include the housing 84 that is principally arranged within the engine compartment 28. The housing 84 includes a base portion 86 which includes a mounting flange attached to the bulkhead 38 by a plurality of bolts. A bearing carrier 88 is intricately formed with the base 86 and extends through an opening in the bulkhead 38. An aft end of the bearing carrier 88 has a reduced diameter which is sized to slip within the casing 60 that surrounds the impeller shaft 56. The housing also includes a cover 90 secured to the housing base 86. The cover 90 and the base 86 together define an enclosed cavity.

A transfer shaft 92 extends rearward from the coupling 78 and carries a drive gear 94 at its aft end. The drive gear mates with a driven gear 96 which is carried at the forward end of the impeller shaft 56. In the illustrated embodiment, the drive gear 94 and the driven gear 96 desirably are straight bevel gears. The pitch angles of these gears desirably are selected to accommodate the resulting shaft angle $_{\alpha}$ existing between the impeller shaft 56 and the transfer shaft 92, which rotates about axis C.

A first bearing assembly 98 supports the drive gear 94 and the transfer shaft 92 within the transmission housing 84. For this purpose, the drive gear 92 lies proximate to this supporting bearing 98. A seal 100 lies forward of the bearing 98 to seal the opening in the transmission cover 90 through which the transfer shaft 92 extends.

Similarly, a second bearing assembly 102 supports the forward end of the impeller shaft 56 and the driven gear 92. The second bearing assembly 102 is located within the bearing carrier 88. A sealing member 104 is arranged behind the second bearing assembly 102. This seal, preferably a grease-backed seal, substantially prevents water, which is present within the casing 60, from entering the transmission housing 84.

FIG. 4 illustrates another arrangement of the propulsion system for a small watercraft 10. In this embodiment, the engine 64 is arranged above the jet propulsion unit 40 and drives the jet propulsion 40 through a V-type transmission 82. The engine 64 is supported within the hull 12 with its crankshaft 74 arranged to rotate around axis C. The crankshaft 74 extends from the crankcase 76 on a front side of the engine 64. The coupling 78 connects the crankshaft 74 to a transfer shaft 92. The transfer shaft 92 also rotates about the axis C and extends forward in a downward direction.

As also seen in FIG. 4, the impeller shaft 56 slopes downward in a forward direction by an angle $_{\alpha}$ relative to the keel 32. A bearing assembly 102 is housed within the forward end of the casing 60. In the illustrated embodiment, the bearing assembly 102 comprises an annular bushing. A seal 104 lies directly behind the bushing and inhibits the egress of water from the casing into the transmission 82.

The transmission 82 includes a housing 84 which is in part integrally formed with the intake duct 42. A strut 106 supports the transmission housing 84 at an elevated position within the engine compartment 28. (Although not illustrated, a bulkhead or similar hull wall separates the engine compartment 28 from the tunnel 36.)

The transmission housing 84 encloses a gear train formed by a drive gear 94 and a driven gear 96. The driven gear 96 is carried at the forward end of the impeller shaft 56 and is supported in mesh engagement with the drive gear 94 by the bushing 102. The forward end of the transfer shaft 92 carries the drive gear 94. A bearing assembly 98 supports and journals the forward end of the transfer shaft and the drive gear within the transmission housing 84. A lubricant seal 100 lies outside the bearing assembly (distal of the gear train) to seal the transmission from the engine compartment 28. In the illustrated embodiment, the drive gear 94 and the driven gear 96 are straight bevel gears. The pitch angle of the gears are selected to accommodate the shaft angles between the transfer shaft 92 and the impeller shaft 56 (i.e., the incident angle between the rotational axis C and rotational axis I). Other gear trains for similar transmission mechanisms, of course, can be used in order to accommodate the V-shaped configuration formed between the engine output shaft 72 and the impeller shaft 56.

In this manner, the engine 64 which is elevated above the jet propulsion unit 40 drives the impeller 48. The output shaft 74 of the engine 64 drives the transfer shaft 92 through the coupling 78. The drive gear 94 in turn drives the driven gear 96 on the forward end of the impeller shaft. The impeller shaft 56, and thus the impeller 48, rotate under the power transferred through the transmission 82. In the illustrated embodiment, the transmission 82 rotates the impeller shaft 56 at the same rotational speed as the transfer shaft 92 and the crankshaft 74. The transmission 82, however, can be configured to rotate the impeller 48 at a different speed than that of the crankshaft 74. For instance, the driven and drive gears 94, 96 can be selected to step down the rotational speed of the impeller shaft 56 from that of the crankshaft 74.

An additional embodiment of the propulsion system is illustrated in FIG. 5 in which the engine 64 is again arranged above the jet propulsion unit 40. In this embodiment, however, the transmission 82 is arranged within the jet propulsion unit 40.

The engine 64 is arranged such that an output shaft 74 of the engine 64 rotates around a generally upstanding axis. In the illustrated embodiment, the axis C is skewed from the vertical by approximately 5° to 15°. The output shaft 74 depends from a lower end of the engine 64 and is supported by a bearing assembly 110 just above the housing 46 of the jet propulsion device 40. Fluid seals prevent the pressurized water within the housing 46 from entering the bearing carrier which surrounds the output shaft 74 at the lower end of the engine 64. The output shaft extends into a central hub 112 formed at the center of the housing 46. A plurality of straightening vanes extend outwardly from the hub 112 and into the pressurization chamber formed within the housing 46. A cap 114 closes the downstream end of the hub 112 which houses the transmission 82.

The transmission 82, in the illustrated embodiment, comprises a gear train formed by a drive gear 94 and a driven gear 96. In the illustrated embodiment, the drive and driven gears 94 and 96 lie at a 90° shaft angle; however, other shaft angles are possible. The drive and driven gears 94, 96 desirably comprise a pair of straight bevel gears. The drive gear 94 is carried at a lower end of the engine output shaft 74 and the driven gear 96 is carried at an aft end of an impeller shaft 56. The drive and driven gears 94, 96 desirably are sized to rotate the impeller shaft 56 at the same rotational speed as that of the engine output shaft 74; however, the gear train can be designed to rotate the impeller shaft 56 at a different rotational speed (i.e., at a step-down rotational speed).

A pair of bearing assemblies 116, 118 journal the front and aft ends of the impeller shaft 56 within the hub 112. A fluid seal 120 lies forward of the front bearing assembly 116 to inhibit water from entering into the central hub 112. The bearing assemblies 116, 118, are arranged to journal the impeller shaft 56 for rotation about a drive axis I. The drive axis I desirably is skewed relative to the keel 32 of the watercraft 10.

The impeller shaft 56 carries the impeller 48 at its front end. In this manner, the engine 64 drives the impeller through the transmission 82*c*. The impeller 48 in turn draws water from the body of water W in which the watercraft is operating through the inlet opening 44 on the bottom side of the hull 14. The impeller then pressurizes the water and forces the water through the discharge nozzle 50.

As common to all the embodiments described above, the water stream exits the discharge nozzle 50 in an upwardly inclined direction S to the surface WL of the body of water W in which the watercraft is operating. As a result, the watercraft's bow rides out of the water, especially when the watercraft is up on plane. Less surface area contact occurs between the hull and the water as a result, thereby lessening drag on the watercraft. The top speed of which the watercraft is capable thus increases to enhance the performance of the watercraft.

Although this invention has been described in terms of a certain preferred embodiment, other embodiments apparent to those of ordinary skill in the art are also within the scope of this invention. Accordingly, the scope of the invention is intended to be defined only by the claims that follow.

What is claimed is:

1. A watercraft comprising a hull having a keel with a generally horizontally extending portion located near an aft end section of the watercraft, the aft end section of the watercraft defining, at least in part, a planing surface, and a propulsion system including an engine and a propulsion unit, the engine having an output shaft coupled to a drive shaft of the propulsion unit to drive the propulsion unit, the engine being located within the watercraft hull and the propulsion unit being carried on an underside of the watercraft hull and including an inlet opening arranged forward of the aft end section of the watercraft, the propulsion unit being arranged thereon to position the drive shaft and a fixed discharge axis of the propulsion unit in an upwardly inclined orientation in a fore-to-aft direction relative to the generally horizontally extending portion of the hull keel.

2. A watercraft as in claim 1 additionally comprising a direct-drive coupling interconnecting the engine output shaft and the drive shaft of the jet propulsion unit.

3. A watercraft as in claim 1 additionally comprising a transmission interconnecting the engine output shaft with the drive shaft of the propulsion unit.

4. A watercraft as in claim 3, wherein the transmission includes a drive member, which rotates about a first axis, and a driven member, which rotates about a second axis, said first and second axes being non-parallel.

5. A watercraft as in claim 4, wherein the drive member and the driven member of the transmission comprise a pair of corresponding gears.

6. A watercraft as in claim 4, wherein the first axis is generally parallel to the generally horizontally extending portion of the hull's keel.

7. A watercraft as in claim 3, wherein the engine is arranged at least partially above the propulsion device.

8. A watercraft as in claim 7, wherein the output shaft of the engine extends in a generally forward direction.

9. A watercraft as in claim 8, wherein the engine is arranged within said hull such that an acute shaft angle exists between the engine output shaft and the drive shaft of the propulsion unit.

10. A watercraft as in claim 7, wherein the output shaft of the engine depends from a lower side of the engine.

11. A watercraft as in claim 10, wherein the transmission is housed within a hub of the propulsion unit.

12. A watercraft as in claim 11, wherein the engine is arranged within said hull such that the engine output shaft and the drive shaft of the propulsion unit lie generally normal to each other.

13. A watercraft as in claim 1, wherein the engine is arranged within the hull to position the output shaft in upwardly inclined orientation in a fore-to-aft direction relative to the generally horizontally extending portion of the hull's keel.

14. A watercraft as in claim 13 additionally comprising a plurality of engine mounts which support the engine within the hull.

15. A watercraft comprising a hull carrying a propulsion system including at least one jet propulsion unit on an underside of the hull, the jet propulsion unit including an inlet opening arranged on the underside of the hull forward of an aft end of the hull such that at least a portion of a planing surface of the hull is defined behind the inlet opening, the jet propulsion unit having an immovable discharge nozzle configured to expel a stream of water along a fixed discharge axis of the jet propulsion unit, said jet propulsion unit being arranged on said hull so as to orient the discharge axis of the jet propulsion unit in an upwardly inclined direction relative of a surface of a body of water in which the watercraft is operated at least when the watercraft is accelerating from rest.

16. A watercraft as in claim 15, wherein said propulsion system additionally comprises an engine which drives the jet propulsion device.

17. A watercraft as in claim 16, wherein said propulsion system includes transmission means for coupling the engine to the jet propulsion device.

18. A watercraft as in claim 17, wherein said transmission means is arranged within the hull forward of the jet propulsion device.

19. A watercraft as in claim 17, wherein said transmission means is arranged within said jet propulsion device.

20. A watercraft as in claim 16, wherein said engine is positioned at least partially above said jet propulsion device.

21. A watercraft as in claim 1, wherein the output shaft of the engine and the drive shaft of the propulsion unit are collinear.

* * * * *